United States Patent [19]

Hoyland

[11] Patent Number: 4,621,479

[45] Date of Patent: Nov. 11, 1986

[54] BAG TYING MACHINE

[75] Inventor: Trevor B. Hoyland, Norfolk, United Kingdom

[73] Assignee: Thurne Engineering Company Limited, Norwich, England

[21] Appl. No.: 799,240

[22] Filed: Nov. 18, 1985

[30] Foreign Application Priority Data

Nov. 16, 1984 [GB] United Kingdom ..... 8428986

[51] Int. Cl.[4] ..... B65B 51/08

[52] U.S. Cl. ..... 53/133; 53/417; 53/583; 53/139.3

[58] Field of Search ..... 53/399, 583, 139.3, 53/133

[56] References Cited

U.S. PATENT DOCUMENTS

| | | | |
|---|---|---|---|
| 3,221,468 | 12/1965 | Casey | 53/583 X |
| 3,783,585 | 1/1974 | Hoyland | 53/583 |
| 4,398,983 | 8/1983 | Suzuki | 53/399 |
| 4,537,005 | 8/1985 | Hoyland | 53/583 X |
| 4,545,185 | 10/1985. | Chikatani | 53/583 |

FOREIGN PATENT DOCUMENTS

| | | | |
|---|---|---|---|
| 7810993 | 5/1980 | Netherlands | 53/583 |
| 1517031 | 7/1978 | United Kingdom | 53/583 |
| 1516499 | 7/1978 | United Kingdom | 53/583 |

*Primary Examiner*—John Sipos

*Attorney, Agent, or Firm*—Sughrue, Mion, Zinn, Macpeak and Seas

[57] ABSTRACT

An automatic machine for forming an adhesive tape tie around the gathered together neck of a filled bag includes a tie former including a reciprocating gripper (41) for pulling a length of pressure sensitive adhesive tape (33) across the path of the gathered together neck of a filled bag and for holding the tape (33) across the path with its adhesive side towards the bag and a clamp (34, 35) for clamping the adhesive side of the adhesive tape (33) around the gathered together neck and onto itself to form the tie. The machine applies folded V-shaped tabs (48) to the adhesive side of the tape (33) on its passage from a supply wheel (43) to the gripper (41), and a cutter (40) cuts the tape (33) to form each tie immediately above each V-shaped tab. The clamp (34, 35) brings the other end of the tie into adhering contact with the other limb of the V-shaped tab (48) to provide a pilfer proof tie with a single tab (48) secured across both ends of the adhesive tape (33) forming each tie.

10 Claims, 7 Drawing Figures

42
44
45
47
46
38
39
33
40
41
48
29

BAG TYING MACHINE

BACKGROUND OF THE INVENTION

Our earlier Patent Specifications GB-A No. 1,381,871, GB-A No. 1,516,499, and GB-A No. 1,517,031 and EP-A No. 84303551 all describe automatic machines for forming an adhesive tape tie around the gathered together neck of a filled bag comprising tie forming means including a reciprocating gripper for pulling a length of pressure sensitive adhesive tape across the path of the gathered together neck of a filled bag and for holding the tape across the path with its adhesive side towards the gathered together neck of the bag, clamping means for clamping the adhesive side of the adhesive tape around the gathered together neck and onto itself to form an adhesive tape tie, means for forming and applying spaced lengths of non-adhesive tape at intervals to the adhesive side of the adhesive tape on its passage from a supply reel to the gripper, and a cutter which cuts the adhesive tape to form each tie. The cutter cuts through the middle of each spaced length of non-adhesive tape so that the ends of the adhesive tape used to form each tie each include a tab of non-adhesive tape. These tabs assist the user of the product packed in the bag in opening the adhesive tape tie.

Our earlier specification GB-A No. 8220925 describes a manually operated bag tying machine which produces an adhesive tape tie in which a single paper tab is attached to the ends of the adhesive tape forming each tie after the tie has been formed around the gathered together neck of the bag. This tie is pilfer resistant since it is necessary to tear the single tab to open the bag. Consequently it is possible to tell that the tie has been tampered with even if the tie is subsequently reclosed.

SUMMARY OF THE INVENTION

According to this invention an automatic bag tying machine comprises means defining a path for gathered together necks of filled bags;

means to hold a supply of pressure sensitive adhesive tape having an adhesive side;

a reciprocating gripper for pulling pressure sensitive adhesive tape across the path of the gathered together necks of filled bags and holding it across the path with the adhesive side towards the gathered together necks of the filled bags;

means for forming and applying one limb of a folded V-shaped tab of non-adhesive tape on its passage from the means to hold a supply to the gripper, each V-shaped tab being located along the adhesive tape at a point that subsequently forms a first end of a tie;

a cutter which cuts the adhesive tape immediately adjacent each tab to form each individual tie with the first end and a second end; and, clamping means for clamping the adhesive side of the adhesive tape around the gathered together neck and onto itself to form an adhesive tape tie, the clamping means bringing the second end of the adhesive tape into adhering contact with the other limb of the V-shaped tab to provide a pilfer proof tie with the V-shaped tab of non-adhesive tape secured across both the first and second ends of the adhesive tape forming each tie.

Preferably the means for forming and applying V-shaped tabs include a tape guide for supporting the non-adhesive side of the adhesive tape upstream of the clamping means, a barrier adjacent the adhesive side of the adhesive tape and downstream of the tape guide, means to feed a non-adhesive tape to the side of the barrier remote from the adhesive tape, and a pusher to push together the non-adhesive tape and the adhesive side of the adhesive tape upstream of the barrier, subsequent movement of the adhesive tape towards the tie clamping means drawing the non-adhesive tape over the barrier and folding it against itself to form the V-shaped tab.

Preferably the tie forming means include a pair of spring-biased clamping jaws immediately downstream of the adhesive tape in the direction of movement of the bags. The clamping jaws support the adhesive tape as the gathered together neck of the bag is urged into contact with it and then clamp the adhesive tape around the gathered together neck of the bag to tie it together.

The bag tying machine may include a guide formed by a pair of endless belts having a converging entry which receives the open end of the neck of a filled bag and a follow-up member which is movable along the guide to gather together the neck of the bag and subsequently drive the gathered together neck of the bag between the clamping jaws. Alternatively the machine includes a pair of counter-rotating wheels which feeds the open end of a filled bag forwards into a containment zone in which it is gathered together. In this case the clamping jaws are movable rearwards into the containment zone to wrap the adhesive tape around the gathered together neck of the bag to form the tie.

BRIEF DESCRIPTION OF THE DRAWINGS

Particular examples of a bag tying machine in accordance with this invention will now be described with reference to the accompanying drawings, in which.

DESCRIPTION OF THE PREFERRED EXAMPLES

Figure 1:
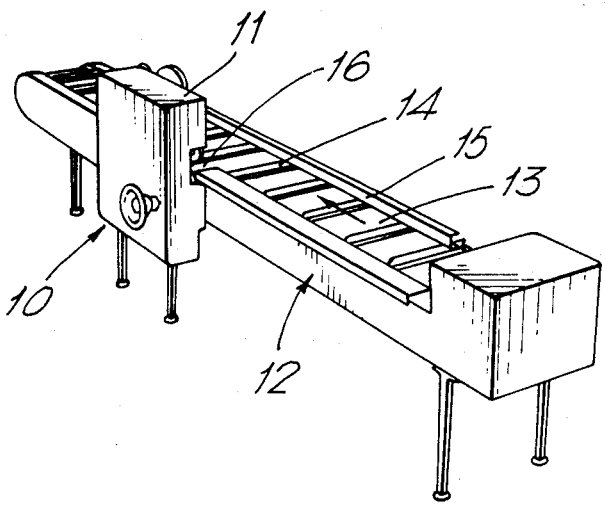
FIG. 1 is a general perspective view of a first example of the machine mounted alongside a conveyor for carrying filled bags.

The first example of a bag tying machine 10 is enclosed by a casing 11 and is mounted at one side of a conveyor 12 which if formed by a surface 13 with flights 14 moving over the surface 13. A curb 15 is located on the opposite side of the conveyor 12 and is arranged to position filled bags laying horizontally on the surface 13 so that their open necks enter an aperture 16. The open necks of the filled bags are guided into the aperture 16 by a pair of counter-rotating brushes (not shown).

Figure 2:
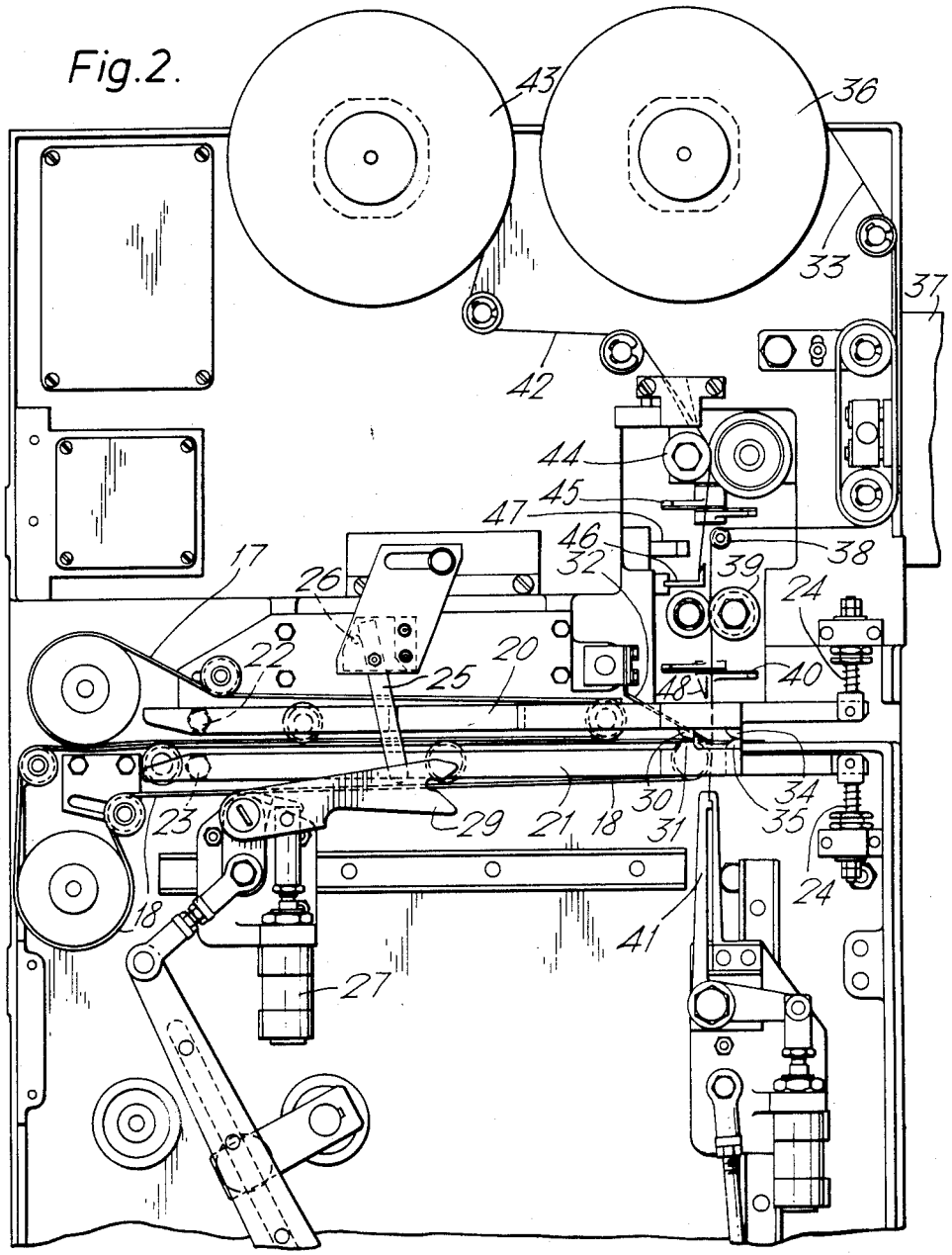
FIG. 2 is a front elevation of the first example.

The bag tying machine includes a pair of endless belts 17 and 18 which come together to form a nip and act as a guide to receive the open end of the filled bag. The pair of arms 20 and 21 which are pivoted around pivots 22 and 23 respectively, also help to define a guide between which the gathered together open neck of the bag passes. The arms 20 and 21 are spring loaded and biased towards one another by springs 24. As the gathered together open end of the bag is drawn between the nip of the belts 17 and 18, opposite sides of the bags are drawn together. The presence of the bag is detected by an arm 25 which hangs down between the arms 20 and 21 and the belts 17 and 18 under gravity, and which is pivoted to the right, as seen in FIG. 2, by passage of a bag. Pivoting of the arm 25 is detected by a proximity detector 26. Upon detection of the open end of a filled bag, a pneumatic ram 27 is actuated to raise a follow up member 29 so that it is aligned with the path of the bag in the nip between the belts 17 and 18. The follow up member 29 is then moved towards the right, as seen in FIG. 2, at a rate faster than the belt speed of the belts 17 and 18, and as it moves forwards from behind the open neck of the bag gathers it together. The leading end of the bag is engaged by a first pair of jaws 30 and 31 formed on the arms 20 and 21 and further movement of the follow up member 29 compresses the end of the bag against the jaws 30 and 31 to gather it together. As the follow up member 29 reaches the jaws 30 and 31 a pnuematic ram (not shown) is actuated to move a subsidiary clamp 32 downwards so that it clamps the free end of the filled bag in position.

Further forwards movement of the follow up member 29 urges the gathered together neck of the bag between the jaws 30 and 31 and, as this occurs, the arms 20 and 21 pivot apart against the bias of the springs 24 and move the gathered together end of the filled bag against a strip of adhesive tape 33 which is supported by a second pair of jaws 34 and 35 also attached to the arms 20 and 21. Further movement of the follow up member 29 urges the gathered together neck of the bag between the jaws 34 and 35 and in so doing clamps the adhesive tape 33 around the gathered together neck of the bag to form a tie around the open end of the gathered together neck of the bag. The clamping operation will be described in detail subsequently. As the gathered together neck of the bag is urged between the jaws 34 and 35 the arms 20 and 21 pivot against the bias of their springs 24.

The adhesive tape 33 is supplied from a supply reel 36, it passes through a hot-foil blocking printer 37, in which the non-adhesive side of the tape 33 is printed with information on the product packed in the bags. The tape 33 passes over a guide roll 38 and then passes through the nip of a pair of rolls 39. The tape 33 then passes between a pair of scissor blades 40 and its free end is held by jaws of a gripper 41. The gripper jaws 41 are movable upwards towards the rolls 39 through the aperture in the amrs 20 and 21, to grip the free end of the tape 33 and pull it from the storage reel 36 and pull it across the path of a gathered together neck of a bag.

Figures 3, 4, 5, 6:
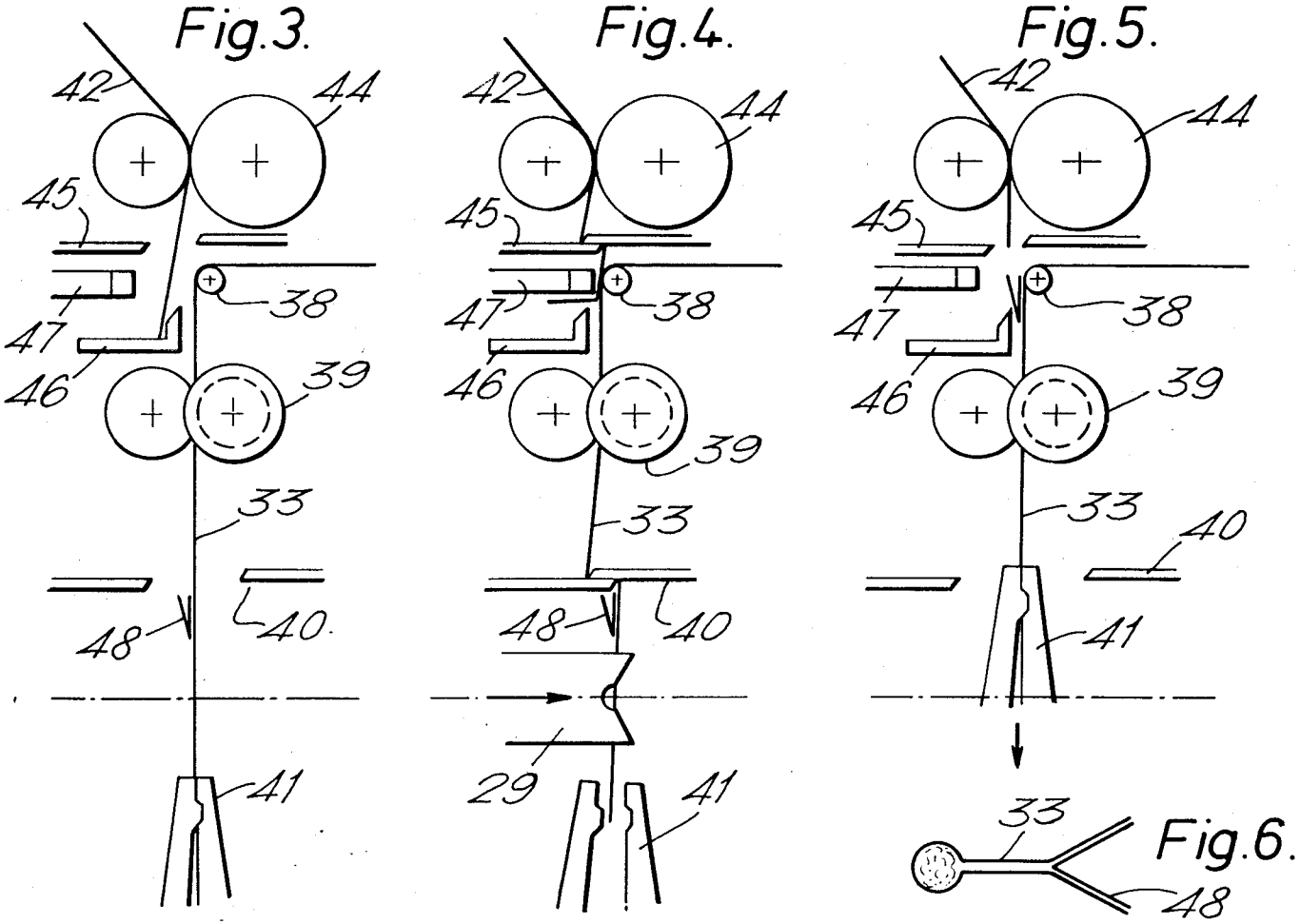
FIGS. 3, 4 and 5 are simplified side elevations to a larger scale of part of the first example.
FIG. 6 is a section through the completed tie.

Paper tape 42 is supplied from a supply reel 43, it passes through the nip of a pair of driven rolls 44, between a pair of scissor blades 45, and its free end passes to the left hand side (as seen in FIG. 3) of a knife edge 46. The knife edge is positioned adjacent the adhesive side of the adhesive tape 33 between the guide 38 and the rolls 39. The two tapes 42, 33 run substantially parallel to each other on opposite sides of the knife edge 46. The non adhesive tape passes down the side of the knife edge 46 remote from the adhesive side of the adhesive tape and so is held away from the adhesive tape 33. A tape pressure arm 47 coupled to the scissor blades 45 to move with them is positioned immediately above the knife edge 46.

The rest position of the bag tying mechanism is shown in FIG. 3. In this position the grippers 41 are in their lowermost position and the adhesive tape 33 extends across the path of the neck of the bag. A V-shaped tab 48 is stuck onto the adhesive side of the adhesive tape 33 just below the scissor blades 40 and paper tape 42 is present on the left hand side of the knife edge 46. After the bag is detected by the bag detector 25, 26, a delay is introduced to allow time for the neck to reach the adhesive tape 33. At the end of this delay the grippers 41 are opened to release the free end of the tape 33, the scissor blades 40 cut the adhesive tape 33 just above the limb of the V-shaped tab 48, the tape pressure arm 47 presses the paper tape 42 onto the adhesive side of the adhesive tape 33 and the scissor blades 45 cut the paper tape 42. This is the point shown in FIG. 4. Further movement of the follow-up member 29 then pushes the gathered together neck of the bag together with the section of tape 33 and tab 48 between the clamping jaws 34 and 35. The clamping jaws clamp the section of tape 33 together with tab 48 around the gathered together neck of a bag and as the free ends of the tape 33 are brought together and pass between the clamping jaws 34, 35 the other end of the adhesive tape 33 is adhered to the other limb of the V-shaped tab 48. This provides a tie with a single non-adhesive tap 48 extending across both free ends of adhesive tape 33 as shown in FIG. 6. The tab 48 makes it easy for the purchaser to grip the ends of the adhesive tape 33 to open the tie and in so doing tear the tab 48. The single tab 48 also enables the purchaser to check that the tie has not been opened previously.

As the compeleted tie passes between the second pair of jaws 34 and 35 the pneumatic ram is deactuated to release the subsidiary clamp 32 and thereby release the free end of the filled bag. The follow up member 29 returns to its initial position and the pneumatic ram 27 is deactuated so that it returns out of the path of a following gathered together neck of the bag. The grippers 41 move upwards through the apertures in the pivoted arms 20, 21 and then close to grip the free end of the tape 33. The gripper 41 then moves downwards and pull the adhesive tape 33 downwards. The portion of the non-adhesive tape 42 on the left hand side of the knife edge 46 is pulled over the top edge of the knife edge 46. Further downward motion of the gippr 41 pulls more tape from the reel 36 and the motion of th adhesive tape past the top edge of the knife edge 46 forces the non-adhesive tape 42 to fold back on itself so forming a V-shaped tab 48 as shown in FIG. 5. As the grippers 41 move downwards the rolls 44 are driven to feed more paper tape 42 to the left hand side of the knife edge 46. This cycle is than repeated for each tie.

Figure 7:
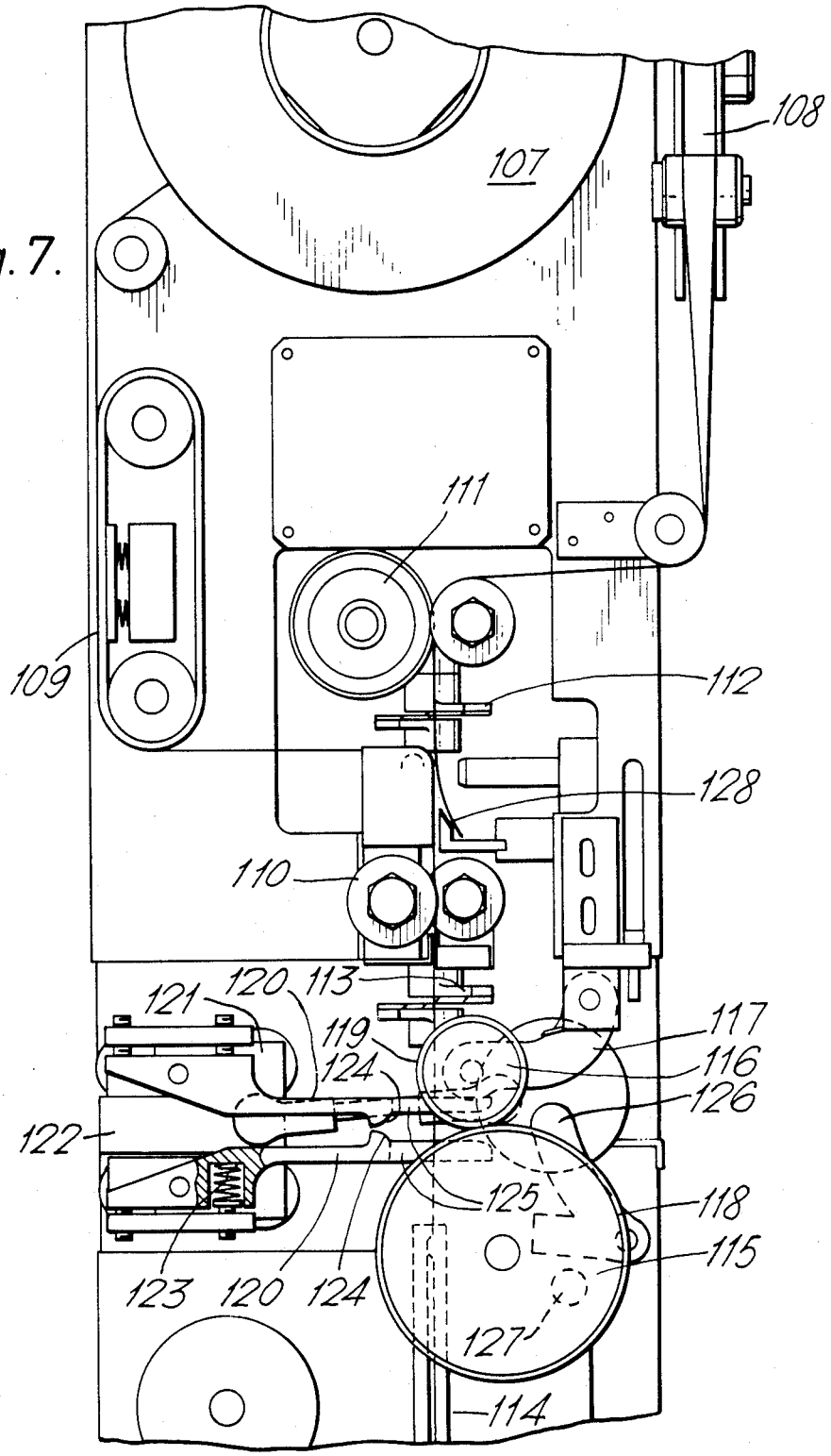
FIG. 7 is a front elevation of a second example.

The second example of bag tying machine is shown in FIG. 7 and includes a reel of adhesive tape 107 and a reel of paper tape 108. Adhesive tape from the reel 107 passes through a hot foil blocking type print unit 109 to a pair of feed rolls 110. The paper tape from the reel 108 passes through a pair of feed rolls 111 and is brought into contact with the adhesive tape upstream from the feed rolls 110. The paper and adhesive tape supply mechanism is generally similar to the first example and includes two pairs of cutting blades 112 and 113 and a gripper unit 114 which grips the free end of the tape and holds it across the path of the ends of the bag to be closed. The gripper unit 114 is opened and closed by actuation of a pnuematic cylinder (not shown).

The open end of a bag to be filled is drawn into a bag entry by the counter-rotating brushes (not shown) and then it passes into the nip between the two pairs of counter-rotating wheels 115 and 116. The pairs of wheels 115 share a common hub and are driven continuously by an electric motor. The pair of wheels 116 are freely rotatbly mounted upon a pair of pivoted arms 117 that are biased by springs (not shown) to urge the wheels 116 against the wheels 115. The wheels 115 and 116 both include rubber tires 118 and 119.

The bag tying mechanism also includes a pair of pivoted clamping jaws 120 which are mounted on a carriage 121 which is movable along a slide 122 towards and away from the wheels 115 and 116. The pivoted clamping jaws 120 are spring biased by compression springs 123 and include curved abutment faces 124. Extending finger portions 125 extend from the curved abutment faces 124 towards and between the wheels 115 and 116 to define a containment zone. The extending fingers 125 include apertures to allow the gripper unit 114 to pass through to grip the free end of the adhesive tape from below the feed rolls 110 and draw the length of adhesive tape through the apertures in the fingers 125 so that it lies between the nip of the wheels 115 and 116 and the aubtment faces 124.

In use, as the open end of a filled bag is fed into the nip between the wheels 115 and 116 these wheels grab the end of the filled bag and feed it into the containment zone defined by the fingers 125, the strip of adhesive tape and the periphery of the wheels 115 and 116. The end of the filled bag is thus gathered together in the containment zone. To form an adhesive tape tie around the gathered together end of the bag the clamping jaws 120 are moved towards the wheels 115 and 116 and in so moving the curved abutment faces 124 press the adhesive tape around the gathered together neck of the filled bag so wrapping the adhesive tape around the gathered together neck of the filled bag. Then, further movement in this direction of the clamping jaws adheres the adhesive side of the free parts of the strip of adhesive tape to one another so that the free parts are adhered to one another. The clamping jaws 120 then retract as the carriage 121 returns to its initial position and this return movement moves the closed end of the filled bag which is now on the opposite side of the curved abutment surface 124 away from the wheels 115 and 116. V-shaped paper tabs (now shown) are applied to the adhesive tape in a similar manner to that described in detail for the first example using the knife edge 128 and so, as the free ends of the tie are brought into contact by the claming jaws 120 the other limb of the tab is brought into contact with the other end of the adhesive tape tie to form a tie as shown in FIG. 6.

The operation of the bag type mechanism is triggered by a bag detector immediately upstream of the nip between the wheels 115 and 116. The detector consists of a lightly spring biased pivoted arm 126 and an associated priximity switch 127. The bag neck in entering the nip between the wheels 115 and 116 moves the arm 126 out of the path of the bag neck and then, as the last part of the bag enters the nip the arm 126 returns into the path of the bag and, in so doing moves away from the proximity switch 127 and triggers the bag tying operation.

I claim:

1. An automatic machine for forming an adhesive tape tie around the gathered together neck of a filled bag comprising:

means (17, 18) defining a path for gathered together necks of filled bags;

means (36) to hold a supply of pressure sensitive adhesive tape having an adhesive side;

a reciprocating gripper (41) for pulling said pressure sensitive adhesive tape across said path of said gathered together necks of filled bags, said gripper holding said adhesive tape across said path with said adhesive side towards said gathered together necks of said filled bags;

means for forming and applying one limb of folded V-shaped tabs (48) of non-adhesive tape (42) at intervals to said adhesive side of said adhesive tape on its passage from said means to hold a supply to said gripper, each said V-shaped tab being located along said adhesive tape at a point that subsequently forms a first end of a tie;

a cutter (40) which cuts said adhesive tape immeditely adjacent each said tab to form each individual tie with said first end and a second end; and, clamping means (34, 35) for clamping said adhesive side of said adhesive tape around said gathered together neck and onto itself to form an adhesive tape tie, said clamping means bringing said second end of said adhesive tape into adhering contact with the other limb of said V-shaped tab to provide a pilfer proof tie with said V-shaped tab of non-adhesive tape secured across both said first and second ends of said adhesive tape forming each said tie, wherein said means for forming and applying said V-shaped tabs includes;

a tape guide (38) for supporting the side of said adhesive tape opposite said adhesive side upstream of said clamping means along the path of said adhesive tape;

a barrier (46) adjacent said adhesive side of said adhesive tape and downstram of said tape guide along the path of said adhesive tape;

feed means (44) to feed said non-adhesive tape to the side of said barrier remote from said adhesive tape; and a pusher (47) to push and attach together said non-adhesive tape and said adhesive side of said adhesive tape upstream of said barrier along the path of said adhesive tape, said V-shaped tab forming means also comprising said gripper that moves said adhesive tape and the attached non-adhesive tape towards said clamping means by drawing said non-adhesive tape over said barrier and folding it against itself to form said V-shaped tab.

2. The machine of claim 1, wherein said clamping means include a pair of spring-biased clamping jaws located immediately downstream of said adhesive tape in the direction of movement of said bags along said path, and wherein said clamping jaws support said adhesive tape as said gathered together neck of said bag is urged into contact with it and then clamp said adhesive tape around said gathered together neck of said bag to form said tie.

3. The machine of claim 2, wherein said means defining a path includes guide means having a pair of endless belts with a converging entry which receives an open end of said neck of a filled bag, and a follow-up member movable along the guide means to gather together said neck of said bag and subsequently drive said gathered together neck of said bag between said clamping jaws.

4. The machine of claim 3, wherein said guide means also include a pair of arms, pivot means connected to each arm at a point close to said divergent belt entry, and resilient biasing means connected to said arms at a point downstream in the direction of flow of the bags from said pivot means.

5. The machine of claim 3, wherein said follow-up member includes means to enable it to be raised and lowered whereby, when raised it is aligned with said guide means to follow each bag and gather together its open end and when lowered whereby said follow up member returns out of said path of said bag along said guide means.

6. The machine of claim 5, which also includes an arm hanging in said path of said bag, means pivoting said arm whereby passage of said bag causes movement of said arm, and a detector to detect a change in position of said arm, said detector triggering a bag tying operation.

7. The machine of claim 1, which also includes a containment zone, and at least one pair of counter-rotating wheels, said at least one pair of counter-rotating wheels feeding an open end of said filled bag forwards into said containment zone in which said open end is gathered together.

8. The machine of claim 7, wherein said clamping means includes jaws movable rearwards into said containmnet zone to wrap said adhesive tape around said gathered together neck of said bag to form said tie.

9. The machine of claim 8 further including resilient means biasing said jaws, and wherein said jaws include curved abutment faces, and finger poritons extending forwards from the said faces and between said wheels to define said containment zone.

10. The machine of claim 9, which also includes an arm hanging in said path of said bag, means pivoting said arm whereby passage of said bag causes movement of said arm, and a detector to detect a change in position of said arm, said detector triggering a bag tying operation.

* * * * *